United States Patent [19]

Holbek

[11] 4,231,297

[45] Nov. 4, 1980

[54] TABLE HAVING AN ADJUSTABLE SUPPORT AND LOCKING SYSTEM FOR THE TOP THEREOF

[75] Inventor: Gert A. E. Holbek, Holte, Denmark

[73] Assignee: Erik Munch, Denmark

[21] Appl. No.: 11,911

[22] Filed: Feb. 13, 1979

Related U.S. Application Data

[63] Continuation of Ser. No. 880,059, Feb. 22, 1978, abandoned.

[30] Foreign Application Priority Data

Feb. 23, 1977 [DK] Denmark ..... 785/77

[51] Int. Cl.[3] ..... A47F 5/12

[52] U.S. Cl. ..... 108/10; 108/4

[58] Field of Search ..... 108/1, 4, 6, 7, 11, 108/12, 10, 145; 248/294, 296, 396, 371

[56] References Cited

U.S. PATENT DOCUMENTS

| | | | |
|---|---|---|---|
| 789,813 | 5/1905 | Longley | 108/4 X |
| 874,052 | 12/1907 | Cantwell | 108/4 |
| 1,057,958 | 4/1913 | Hallock | 108/4 |
| 2,944,858 | 7/1960 | Engelsted | 108/4 |
| 3,988,021 | 10/1976 | Grover | 108/10 X |

FOREIGN PATENT DOCUMENTS

| | | | |
|---|---|---|---|
| 955089 | 1/1950 | France | 108/7 |
| 965492 | 7/1964 | United Kingdom | 108/4 |

*Primary Examiner*—Ramon S. Britts

*Assistant Examiner*—Peter A. Aschenbrenner

*Attorney, Agent, or Firm*—Watson, Cole, Grindle & Watson

[57] ABSTRACT

To allow adjustment of the table top of a table the table top is connected to the subframe of the table by means of a rigid U-shaped member, the branches of which are pivotally connected to the subframe about a horizontal axis, and the intermediate part of which is pivotally connected to the table top about an axis extending parallel with the pivot axis of the branches. A first telescopically extensible rod, the length of which is adjustable from a predetermined initial length which corresponds to the distance between the pivot axis of the branches and the pivot axis of the intermediate part of the U-shaped member, has one end pivotally connected with the frame at a distance from the pivot axis of the branches, and the other end pivotally connected with the table top at a distance from the pivot axis of the intermediate part, which distance corresponds to the distance between one end of the first rod and the pivot axis of the branches. A second telescopically extensible rod has one end of which is pivotally connected with the frame and the other end pivotally connected with the table top at a distance, as seen in a direction perpendicular to the pivot axis of the intermediate part, from the other end of the first rod, the pivot connections of the other rod being selected so that the other rod forms an angle different from nil together with the plane defined by the pivot axis of the branches and the pivot axis of the intermediate part.

10 Claims, 6 Drawing Figures

TABLE HAVING AN ADJUSTABLE SUPPORT AND LOCKING SYSTEM FOR THE TOP THEREOF

This application is a continuation application of U.S. application Ser. No. 880,059, filed Feb. 22, 1978, now abandoned.

BACKGROUND OF THE INVENTION

This invention relates to a table comprising a table top which is adjustable both as regards the height and the slope of the table top.

A table top of the kind referred to above is known, e.g., from U.S. Pat. No. 1,057,958, wherein the table top is connected with the subframe of the table by four rods. The top ends of the rods are pivotally connected to the table top near the corners of the table top and the lower ends of the rods are connected with the subframe of the table by clamping and gripping elements provided with clamping means. By disengaging the clamping means, the rods may be pushed downwards or be moved upwards with respect to the clamping and gripping elements in order to adjust the height or slope of the table top. After such adjustment the rods are locked by reclamping the clamping means. The known table referred to above, moreover, comprises a pair of swinging links which connect the top ends of two of the rods and the clamping and gripping elements of the other two rods.

The main object of the present invention is to provide a table, the table top of which is adjustable, as previously mentioned, by improved supporting and locking means comprising a very few movable parts only which nevertheless offer a broad range of different positions of the table top and are easily handled.

SUMMARY OF THE INVENTION

According to the present invention the table is characterized by a rigid U-shaped member, the branches of which are pivotally connected to a subframe of the table about a horizontal axis, and the intermediate part of which is pivotally connected to the table top about an axis extending parallel with the pivot axis of the branches; a first telescopically extensible rod, the length of which is adjustable from a predetermined initial length which corresponds to the distance between the pivot axis of the branches and the pivot axis of the intermediate part of the U-shaped member, one end of the first rod being pivotally connected with the subframe of the table at a distance from the pivot axis of the branches, the other end of said first rod being pivotally connected with the table top at a distance from the pivot axis of the intermediate part, which distance corresponds to the distance between said one end of said first rod and the pivot axis of the branches; a second telescopically extensible rod, one end of which is pivotally connected with the subframe and the other end of which is pivotally connected with the table top at a distance, as seen in direction perpendicular to the pivot axis of the intermediate part, from said other end of said first rod, the pivot connections of said other rod being selected so that said other rod forms an angle different from nil together with the plane defined by the pivot axis of the branches and the pivot axis of the intermediate part. By means of this construction it is achieved that the branches of the U-shaped member and the first rod together with the table top and the frame will form a parallelogram as seen in the longitudinal direction of the intermediate part of the U-shaped member and by means of such parallelogram the table top may be controlled parallel with itself when the branches and the first rod are pivoted. However, when the second rod is locked such movement and, accordingly, an adjustment of the height of the table top will be prevented and the table top will be supported in a stable way. However, if the length of the second rod is adjusted, such adjustment will, due to the fact that the second rod is not parallel with the branches and the first rod respectively, change the distance between the subframe and the table top and during such adjustment the table top will be controlled so as to be moved in parallel with itself due to the parallelogram. Accordingly, the table top may be adjusted as regards the height in parallel with itself without needing any complicated and expensive guiding means. However, if the length of the first rod is adjusted while the length of the second rod is maintained constant, the slope of the table top may be adjusted with respect to horizontal direction, seeing that one side of the parallelogram mentioned above will be extended. By manoeuvring the two rods, the table top may, accordingly, be moved parallel with itself and be pivoted, respectively. Nothing prevents a simultaneous manoeuvring of both rods, but the possibility of moving the table top parallel with itself by means of one rod and pivoting the table top by means of the other rod is very valuable due to the fact that such sort of manoeuvring makes it easy to adjust the position of the table top. Such easy positioning of the table top may be further promoted, if, according to a preferred embodiment of the invention, the telescopically extendable rods consists of cylinder and rod assemblies, wherein the cylinders contain a gas filling, seeing that such assemblies, by unlocking, may counter-balance, in full or partly, the weight of the table top in such a way that the manuel forces necessary in order to adjust the table top may be kept at a minimum.

A further preferred embodiment of the table according to the invention is characterized by the two rods being arranged in a plane extending generally perpendicular to the table top and centrally between the end edges of the table top and by the lower ends of the rods, moreover, being pivotally connected with the subframe adjacent each other and generally at the same height as the pivot axis of the branches of the U-shaped member. Such embodiment is advantageous because the table top will be symmetrically supported between the end edges of the table top. Moreover, the arrangement of the lower ends of the rods adjacent each other makes it possible to use only one support for the rods below the table top which offers good accomodation space for the legs and feet of a person sitting at the table. Moreover, the rods will be loaded only along the longitudinal directions of the rods and, accordingly, when the table top is loaded, only either tension or compression forces will be applied to the rods. Moreover, if that side of the table at which the branches of the U-shaped element are pivoted, is used as the working side of the table, it is achieved that the table top, by increasing the height position thereof, simultaneously will be moved a little in direction towards a person sitting at the table. By such movement, an adaptation is simultaneously achieved, viz. to the length of the legs of a sitting person. The higher a person is, the longer will his thighs and his crura be and, accordingly, it is advantageous that the overhang of the table top is increased simultaneously with increasing the heights of the table top.

DESCRIPTION OF THE PREFERRED EMBODIMENTS

Figure 1:
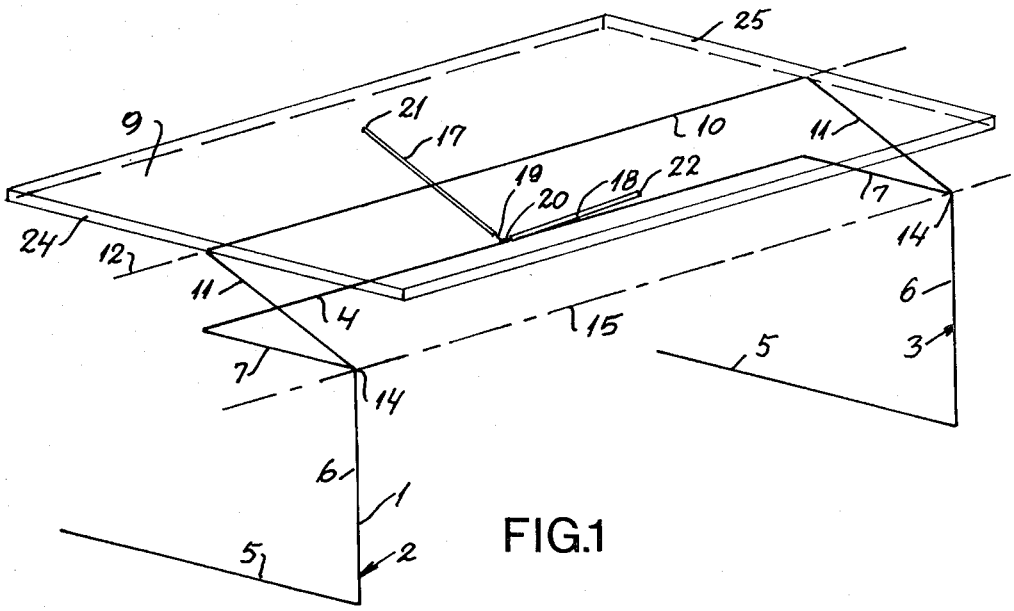
FIG. 1 shows a perspective view of a first embodiment of the table according to the invention highly simplified.

The embodiment of the table illustrated in FIGS. 1–4 comprises a subframe 1 which, for the sake of clarity, is shown in the form of a single line. The frame comprises two end frames 2 and 3 which are mutually connected by means of a horizontal rod 4. Each end frame comprises a base 5, a column 6 and a horizontal frame member 7. The frame rod 4 is secured between the two ends of the frame members 7 facing away from the columns 6. The table also comprises a table top 9 which is indicated by thin lines in order to indicate that the table top is to be regarded as transparent in order not to hide the structural elements positioned below the table top. The table top is connected with the subframe 1 by means of a U-shaped element, the branches of which are designated 11,11 and the intermediate part of which is designated 10. The intermediate part 10 is pivotally connected with the lower surface of the table top along the longitudinally extending centre axis which is indicated by 12 on the drawing. The branches 1 are pivotally connected with the end frames 2 and 3 by means of pivots 14,14 which define an axis indicated in FIG. 1 by means of a broken line 15. The table top 9 is furthermore supported by two telescopically extensible rods 17 and 18. The rods 17 and 18 are at their first or lower ends 19,20 pivotally connected with the subframe 1, viz. at the centre of the horizontal rod 4 and the other or upper ends 21,22 of the rods 17 and 18 are pivotally connected with the lower surface of the table top at each side of and spaced equally from the centre axis 12. Accordingly, it will be understood that the two telescope rods 17 and 18 are arranged in a plane which extends perpendicular to the table top 9 at the centre between the end edges 24 and 25 of the table top. In FIGS. 1–4 the rods 17 and 18 are illustrated very simplified and in practice they consist of so-called gas springs or gas cylinders, i.e. cylinder-piston assemblies having outwardly extending piston rods. Such cylinders are available on the market. Such cylinders have the capacity that they, when released, push their piston rods outwardly with a predetermined force and, oppositely, it is possible to press the piston rods into the cylinders by applying such predetermined force to the piston rods. Springs of this kind may be locked in any requested position, viz. between the fully extended position of the piston rods and in the position of the piston rods where the piston rods are pressed fully into the corresponding cylinders. When locked the length of the springs is maintained constant. The springs may be released and re-locked by means of handles which for the sake of clarity have not been shown in FIGS. 1–4. Moreover, such springs or cylinders may be remote-controlled, e.g. by means of Bowden-cables.

Figure 2:
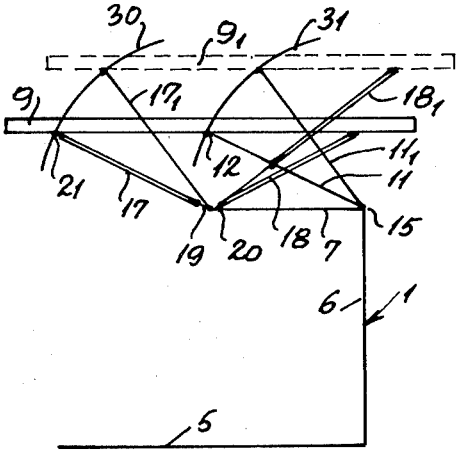
FIG. 2 shows an end view of the table shown in FIG. 1 with the table top horizontal and in the lowermost position.

The length of one of the rods 17 is adjustable from a predetermined initial length at which the length of the rod 17 corresponds to the length of the branches 11 which, as will be understood, corresponds to the distance between the pivot axis 12 of the intermediate part 10 and the pivot axis of the branches 11, cf. FIG. 2, wherein the rod 7 is shown adjusted to this length. This length may e.g., be the length which the rod has when the parts thereof have been fully telescoped into each other.

From FIG. 2 it will be seen that the branches 11,11, the rod 17, when adjusted in its predetermined initial length, the table top 9 and the frame elements 7 form a parallelogram in FIG. 2, wherein the table is seen in direction of the pivot axis 12 of the intermediate part 10 of the U-shaped member, and accordingly also is seen in direction of the pivot axis 15 of the branches. Due to this parallelogram, the table top 9 will be moved parallel with itself by adjustment of the length of the telescope rod 18 due to the fact that the U-shaped member and the telescope rod 17 will not change their mutual angle, and will maintain the table top and the frame members 7 parallel with each other. Such parallel movement of the table top will always occur, provided the other telescope rod 18 forms an angle different from nil together with the plane containing the U-shaped member 10,11 or, in other words, the plane defined by the pivot axis 12 of the U-shaped member and the pivot axis 15 of the branches. This fact may also be expressed in the way that the other telescope rod 18 must not be parallel with the first telescope rod 17 or the branches 11 of the U-shaped member. Accordingly, an adjustment of the height of the table top may be carried out solely by changing the length of the telescope rod 18. During such adjustment the table top 9 will be moved a little to the right in FIG. 2. However, such movement is advantageous, provided the person using the table is positioned at the right hand side of the table in FIG. 2. If the person using the table is rather high and, accordingly, wishes to increase the height of the table top, the movement to the right of the table top during the lifting thereof will simultaneously result in a movement of the edge of the table adjacent the sitting person towards the sitting person and, accordingly, a compensation is achieved as regards the comparatively long thighs of the high person. Preferably, the adjustment as regards the height of the table top is carried out while the telescope rod 17 occupies the predetermined initial length, but the adjustment in the height direction may also be carried out even if this is not the case.

Figure 3:
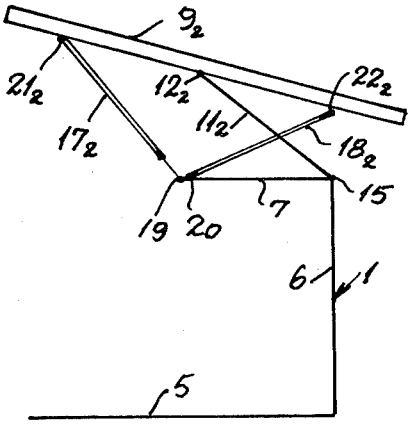
FIG. 3 shows a view corresponding to FIG. 2, but wherein the table top has been pivoted.

If the length of the other telescope rod 18 is maintained unchanged and the length of the first telescope rod 17 is increased, the table top will be pivoted clockwise as seen in FIG. 2, cf. the pivoted or tipped position illustrated in FIG. 3.

Figure 4:
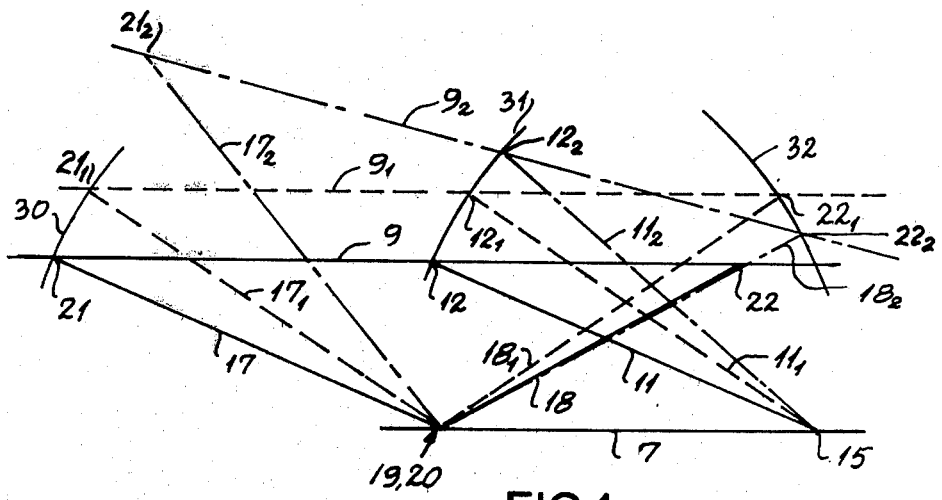
FIG. 4 shows a diagram for illustrating the movements of the table top of the table shown in FIG. 1.

The operations for adjusting the height and pivoting the table top may easily be understood with reference to FIG. 4. In FIG. 4 the same references to the drawing have been used as in FIGS. 1, 2 and 3 and, accordingly, 7 designates the frame members 7 as seen in the direction of the axis 12; 15 designates the pivot axis of the branches 11,11; 19,20 designate the lower ends of the telescope rods 17,18; 21 and 22 designate the pivots for the upper ends of the telescope rods, and 9 designates the table top. The elements occupy in the start position the positions shown in FIG. 4 with full lines, wherein accordingly the table top 9 is in a horizontal position. It will easily be understood that when the length of the rod 18 is extended to the condition indicated by broken lines at $18_1$, the top end of the rod 17 will pivot along an arch 30 having the lower end of the rod 17 as its centre, and moreover the branches 11 will pivot along an arch 31 having the pivot axis 15 of the branches as its centre. Accordingly, the table top will be brought to the position indicated in FIG. 4 by means of broken lines and provided with the reference numeral $9_1$. The rod 17 will occupy the position indicated at $17_1$ and the branches 11 will occupy the position $11_1$. Accordingly, it will be understood that the height or level position has been increased and simultaneously the table top has been moved a little to the right in FIG. 4. If it is requested to adapt the slope of the table top, the length of the rod $18_1$ is maintained unchanged, whereas the rod $17_1$ is extended. During such adaptation, the pivot axis 12 of the intermediate part 10 is confined to be moved along the arch 31 and the upper end of the rod 18 will be confined to be moved along an arch 32 having the lower end 20 of the rod 18 as its centre. Moreover, the distance between the pivot axis $12_1$ of the intermediate part and the pivot connection $22_1$ at the upper end of the rod $18_1$ will be constant because the table top is not extensible and, accordingly, the table top may be pivoted to any of the slopes fulfilling these conditions. In FIG. 4 only one position $9_2$ is illustrated wherein the table top slopes. This position has been indicated by means of dot-and-dash lines both as regards the table top, the rod $17_2$, the rod $18_2$ (which in FIG. 4 unfortunately extends almost in the same direction as the direction in which the rod 18 extends in the lowermost horizontal position of the table top 9) and the branches $11_2$.

If requested, the length of both the rods 17 and 18 may be adjusted simultaneously, but in practice this is less advantageously. From FIG. 2 it will be seen that a release of only one of the rods 17 and 18 will release the table top 9. If both the rod 17 and 18 are released, the table top will obtain two degrees of freedom which will make it rather difficult to control the table top manually. Accordingly, it is preferred to manoeuvre the rods or gas springs one at the time, but of course it is not necessary to adjust the table top in its horizontal position from a pivoted position before the height is changed, seeing that this may be done immediately by extending the rod 18 while the table top is in its pivoted position. However, by such adjustment the slope of the table top will be slightly changed but under such circumstances it is possible to adjust the slope aimed at, after the requested height position has been achieved.

The embodiment illustrated in FIGS. 1–4 is advantageous in that the table top 9 is symmetrically supported. However, the operations explained above, as regards the adjustment of the height and the adjustment of the slope, may also be achieved even though this symmetry has not been followed. However, it is a condition, as indicated above, that the other telescope rod 18 does not extend parallel with the plane defined by the pivot axis 12 of the intermediate part 10 and the pivot axis 15 of the branches 11. Moreover, the upper ends of the telescope rods 17 and 18 should not be pivotally connected with the table top adjacent each other, because, if this is the case, an adjustment of the slope of the table top will necessitate an adjustment of both of the telescope rods simultaneously, and moreover such arrangement will result in a poor support of the table top.

In FIGS. 1–4 only a very simplified subframe has been illustrated, but it will be understood that several possibilities exist as regards the construction of the subframe of the table. For instance the subframe may consist of two solid gables connected by means of a frame beam for supporting the rods 17,18. Moreover, it should be mentioned that the U-shaped member 10,11 should be selected rather strong and the intermediate part 10 should be as resistant as possible against twisting. If a yieldable U-shaped member is used, the branches 11 may be caused to straddle and, accordingly, the table top will have a tendency to rotate in its own plane. For the sake of clarity the hinges by means of which the intermediate part 10 is connected with the table top 9 have not been shown in FIGS. 1–3, but it will be understood that the intermediate part 9 should be pivotally connected with the table top at at least two points and, of course, the stable nature of the furniture will be maximum in case the intermediate portion 10 supports the table top along the full length of the table top. However, nothing prevents a reduction as regards the length of the intermediate portion 10 with respect to the length shown on the drawing, seeing that in such case the branches 11 will only extend convergent inwardly towards each other, as seen in direction towards the intermediate part. Moreover, the hinges by means of which the rods 17 and 18 are connected with the table top 9 and the horizontal rod 4, respectively, have not been indicated in FIGS. 1–4 for the sake of clarity. Due to the rigidity of the U-shaped member, which secured that the direction of the pivot axis 12 always will be maintained, it is avoided that forces will be applied to the rods 17,18 which may have a tendency to twist the rods away from the plane wherein the rods are arranged. Accordingly, the two ends of the rods 19,21 and 20,22 respectively, may be connected with the horizontal rod 4 and the table top, respectively, by means of simple hinges the pivot pins of which extend parallel with the pivot axes 12 and 15 and need not be connected e.g. by means of spherical joints, in order to avoid jamming during the adaptation of the length of the rods, because only compression or tension will be applied to the rods when forces are being applied to the table top.

Figure 5:
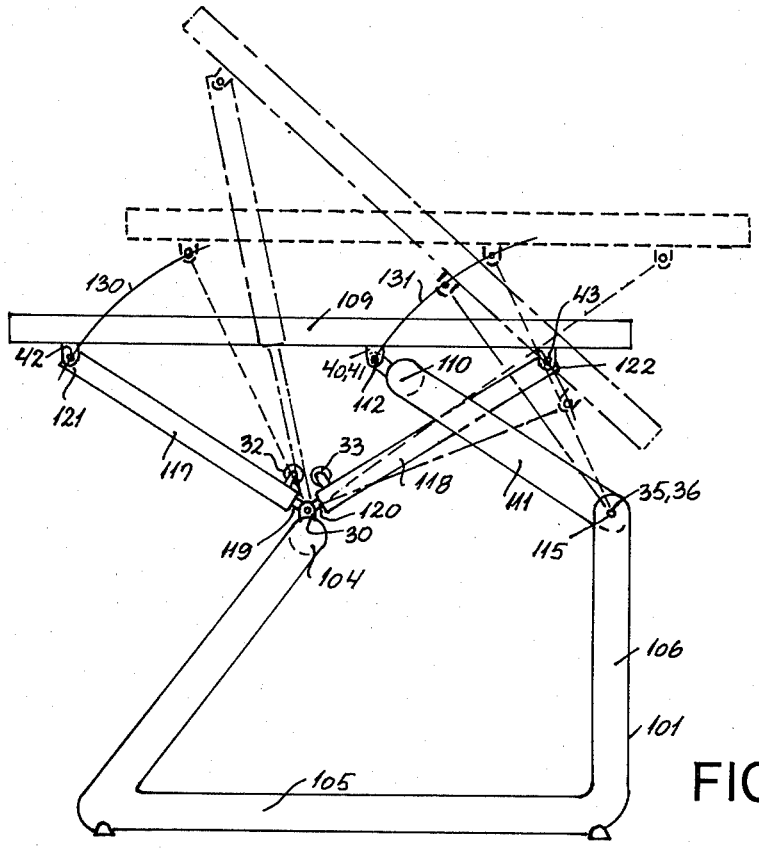
FIG. 5 shows an end view of another embodiment of the table according to the invention with the table top adjusted in three different positions.
Figure 6:
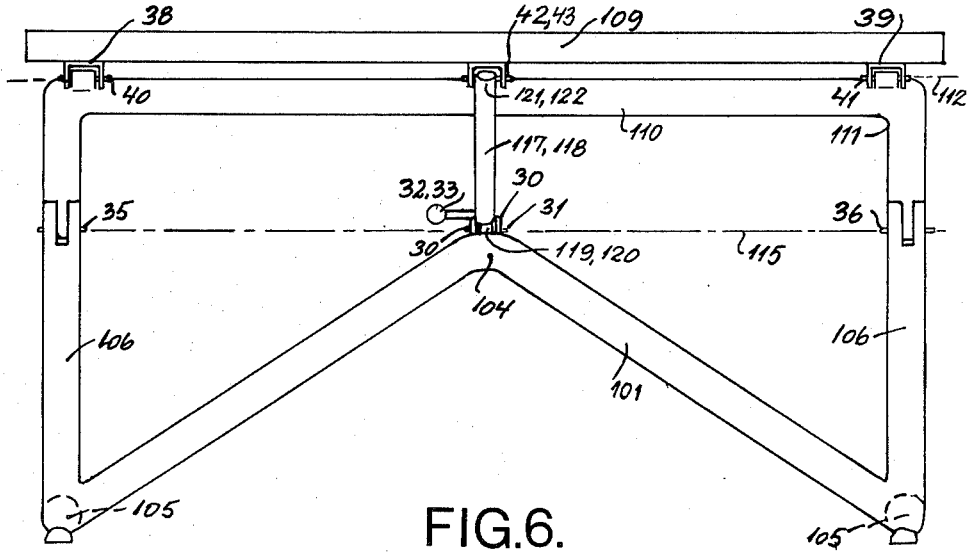
FIG. 6 shows a front view of the table in FIG. 5 with the table top in horizontal position.

The embodiment illustrated in FIGS. 5 and 6 differs from the embodiment illustrated in FIGS. 1–4 as regards the subframe. According to FIGS. 5 and 6 the subframe 101 consists of two upstanding column elements 106,106 corresponding to the legs 6,6 illustrated in FIG. 1, two basis elements 105 connected to the lower ends of the elements 106 and a V-shaped element secured between the ends of the elements 105 facing away from the columns 106. The V-shaped element is arranged with the apex thereof pointing upwards so as to form a support 104 generally at the same level as the top ends of the column elements 106. From FIGS. 5 and 6 it will be understood that the support 104 corresponds to the central portion of the horizontal rod 4 in FIG. 1 and serves the same purpose, viz. to support the lower ends of the two cylinder-rod assemblies which in FIGS. 5 and 6 have been designated 117 and 118. Moreover, all other parts of the embodiment illustrated in FIGS. 5 and 6, corresponding to those of the embodiment illustrated in FIGS. 1–4, have in FIGS. 5 and 6 been provided with the same references increased by the figure 100. The lower ends 119 and 120 of the two assemblies 117 and 118 are hinged to the support 104 by means of two lugs 30,30 secured to the support 104, e.g. by welding and through which a pivot pin 31 extends. Moreover, the pivot pin 31 extends through holes provided at the outer ends of the two piston rods of the two cylinder assemblies 117,118.

Moreover, from FIGS. 5 and 6 it is clearly apparent that each of the cylinder assemblies 117,118 is provided with a handle 32 and 33, respectively, by means of which the corresponding piston rod may be locked and released with respect to the corresponding cylinder as explained above with respect to FIGS. 1–4. In the position of the cylinder assembly 117 illustrated in FIG. 5, said cylinder assembly occupies its shortest length which, in the present instance, constitutes the initial length as previously explained. The piston rod of the cylinder assembly 117 has, in FIG. 5, been pushed fully into the corresponding cylinder and in this condition of the cylinder assembly 117 the length thereof corresponds to the distance between the pivot axis 115 of the U-shaped member 111 with respect to the subframe. The pivot axis 115 is defined by two pivot pins 35 and 36, each of which extends through the top end of a corresponding column 106. The top end of each column 106 is fork-shaped and accomodates a lug at the end of the corresponding branch of the U-shaped member 111. The pivot axis 112 of the table top 109 with respect to the U-shaped member 111 is defined by two hinges 38 and 39, FIG. 6, each comprising a fork secured to the lower surface of the table top 109, a bearing secured to the intermediate part 110 of the U-shaped member and a pivot pin 40,41, respectively. The upper ends 121 and 122 of the two cylinder assemblies 117 and 118 are pivotally connected with the lower surface of the table top 109 by means of hinges, each comprising a fork secured to the lower surface of the table top 109 and a pivot pin 42,43 passing through the corresponding lugs and a hole provided in the adjacent end of the corresponding assembly 117,118.

Due to the fact that the embodiment illustrated in FIGS. 5 and 6 operates in exactly the same way as explained above with respect to FIG. 4, a detailed explanation of the mode of operation of the embodiment in FIGS. 5 and 6 will be superfluous. It should only be mentioned that the same line signatures have been used in FIG. 5 as regards the different positions illustrated therein, as have been used in FIG. 4.

I claim:

1. Table, comprising a table top which is adjustable both as regards the height and the slope of the table top, characterized by a rigid U-shaped member, the branches of which are pivotally connected to a subframe of the table about a horizontal axis, and the intermediate part of which is pivotally connected to the table top about an axis extending parallel with the pivot axis of the branches; a first telescopically extensible rod, the lengths of which is adjustable from a predetermined initial length which corresponds to the distance between the pivot axis of the branches and the pivot axis of the intermediate part of the U-shaped member, one end of the first rod being pivotally connected with the subframe of the table at a distance from the pivot axis of the branches, the other end of said first rod being pivotally connected with the table top at a distance from the pivot axis of the intermediate part, which distance corresponds to the distance between said one end of said first rod and the pivot axis of the branches; a second telescopically extensible rod, one end of which is pivotally connected with the subframe and the other end of which is pivotally connected with the table top at a distance, as seen in direction perpendicular to the pivot axis of the intermediate part, from said other end of said first rod, the pivot connections of said other rod being selected so that said other rod forms an angle different from nil together with the plane defined by the pivot axis of the branches and the pivot axis of the intermediate part.

2. Table according to claim 1, wherein the two rods are arranged in a plane extending generally perpendicular to the table top and centrally between the end edges of the table top, said one end of the rods, moreover, being pivotally connected with the subframe adjacent each other and generally at the same height as the pivot axis of the branches.

3. Table according to claim 1, wherein the pivot axis of the intermediate part of the U-shaped member extends generally along the mid-line of the table top and said other ends of said two rods being positioned at generally the same distance from the centre line at either side of the pivot axis of the intermediate part.

4. Table top according to claim 1, wherein the extensible rods consist of cylinder and rod assemblies wherein the cylinders contain a gas filling.

5. A table comprising a table top; a subframe positioned below the table top, a rigid link member which is pivotally connected to the subframe about a first horizontal axis and is likewise pivotally connected to the table top at at least two points along a second horizontal axis extending parallel with said first horizontal axis; a first rod, said first rod having a length which is maintainable at a predetermined constant value which corresponds to the distance between said first and second horizontal axes, one end of said first rod being pivotally connected with said subframe at a distance from said first horizontal axis and the other end of said first rod being pivotally connected with the table top at a distance from said second horizontal axis, which distance corresponds to the distance between said one end of said first rod and said first horizontal axis; a second rod, said second rod being telescopically adjustable in length, one end said second rod being pivotally connected with the subframe and the other end being pivotally connected with the table top at a distance, perpendicularly to said second horizontal axis, from said other end of said first rod, the pivot connections of said second rod being so selected that said second rod forms an angle different from zero with the plane defined by said first and second horizontal axes.

6. A table as in claim 5 wherein said first rod is telescopically adjustable from said predetermined length.

7. A table as in claim 5 wherein said link member is U-shaped, the branches of the U-shape being pivotally connected to the subframe, and the intermediate part of the U-shape being pivotally connected to the table top at at least two points.

8. A table as in claim 5 wherein said first and second rods are arranged in a plane extending generally perpendicular to the table top and centrally between the end edges of the table top, said one end of each of said first and second rods being pivotally connected with the subframe adjacent each other and generally at the same level as said first horizontal axis.

9. A table as in claim 5, wherein said second horizontal axis extends generally along the center-line of the table top, and said other ends of each of said first and second rods being positioned at generally the same distance from said centre line at opposite sides thereof.

10. A table as in claim 5, wherein said second rod comprises a cylinder and rod assembly, and wherein the cylinder contains a gas filling.

* * * * *